US010605263B2

(12) United States Patent
Moore et al.

(10) Patent No.: US 10,605,263 B2
(45) Date of Patent: Mar. 31, 2020

(54) INTERNALLY-COOLED COMPRESSOR DIAPHRAGM

(71) Applicant: DRESSER-RAND COMPANY, Olean, NY (US)

(72) Inventors: James Jeffrey Moore, Midlothian, TX (US); Kevin Michael Hoopes, San Antonio, TX (US); Stefan David Cich, San Antonio, TX (US); Jason M. Kerth, Houston, TX (US)

(73) Assignee: DRESSER-RAND COMPANY, Olean, NY (US)

( * ) Notice: Subject to any disclaimer, the term of this patent is extended or adjusted under 35 U.S.C. 154(b) by 281 days.

(21) Appl. No.: 15/542,082

(22) PCT Filed: Jan. 27, 2016

(86) PCT No.: PCT/US2016/015140

§ 371 (c)(1),
(2) Date: Jul. 7, 2017

(87) PCT Pub. No.: WO2016/133665

PCT Pub. Date: Aug. 25, 2016

(65) Prior Publication Data

US 2018/0274550 A1 Sep. 27, 2018

Related U.S. Application Data

(60) Provisional application No. 62/116,994, filed on Feb. 17, 2015.

(51) Int. Cl.

| | |
|---|---|
| ***F04D 29/42*** | (2006.01) |
| ***F04D 29/44*** | (2006.01) |
| ***F04D 29/58*** | (2006.01) |

(52) U.S. Cl.
CPC ..... *F04D 29/4206* (2013.01); *F04D 29/444* (2013.01); *F04D 29/5826* (2013.01)

(58) Field of Classification Search
CPC ..... F04D 29/444; F04D 29/5826
See application file for complete search history.

(56) References Cited

U.S. PATENT DOCUMENTS 7,469,689 B1 12/2008 Jones et al.
8,814,509 B2 8/2014 Moore et al.
(Continued)

FOREIGN PATENT DOCUMENTS

JP H01318790 A 12/1989
JP H10141290 A 5/1998
(Continued)

OTHER PUBLICATIONS

PCT International Search Report and Written Opinion dated Jul. 15, 2016 corresponding to PCT Application PCT/US2016/015140 filed Jan. 27, 2016.

*Primary Examiner* — Igor Kershteyn
*Assistant Examiner* — Brian O Peters

(57) ABSTRACT

An internally-cooled diaphragm for an internally-cooled compressor is provided. The internally-cooled diaphragm may include an annular body configured to cool a process fluid flowing through a fluid pathway of the internally-cooled compressor. The annular body may define a return channel of the fluid pathway, and a cooling pathway in thermal communication with the fluid pathway. The return channel may be configured to at least partially diffuse and de-swirl the process fluid flowing therethrough, and the cooling pathway may be configured to receive a coolant to absorb heat from the process fluid flowing through the return channel.

15 Claims, 7 Drawing Sheets

(56) References Cited

U.S. PATENT DOCUMENTS

| | | | |
|---|---|---|---|
| 2004/0055740 | A1 | 3/2004 | Meshenky et al. |
| 2005/0058535 | A1 | 3/2005 | Meshenky et al. |
| 2009/0139699 | A1 | 6/2009 | Li et al. |
| 2011/0014028 | A1 | 1/2011 | Wood et al. |
| 2011/0142607 | A1 | 6/2011 | Ciro et al. |
| 2012/0063882 | A1 | 3/2012 | Moore et al. |

FOREIGN PATENT DOCUMENTS

| | | | | |
|---|---|---|---|---|
| JP | 2008286198 | A | | 11/2008 |
| JP | 2010265784 | A | | 11/2010 |
| JP | 3187468 | U | | 11/2013 |
| WO | WO2014007791 | | * | 1/2014 |
| WO | 2014134266 | A1 | | 9/2014 |

* cited by examiner

INTERNALLY-COOLED COMPRESSOR DIAPHRAGM

This application claims priority to U.S. Provisional Patent Application having Ser. No. 62/116,994, which was filed Feb. 17, 2015. The aforementioned patent application is hereby incorporated by reference in its entirety into the present application to the extent consistent with the present application.

STATEMENT REGARDING FEDERALLY SPONSORED RESEARCH OR DEVELOPMENT

This invention was made with government support under DE-FC26-05NT42650 awarded by the United States Department of Energy. The government may have certain rights in this invention.

Compressors, such as centrifugal compressors, may often be utilized to increase a pressure of a process fluid in a myriad of applications and industrial processes. Increasing the pressure of the process fluid through compression may correspondingly increase a temperature of the process fluid. For example, in multistage compressors having a plurality of compressor stages, the compressed process fluid discharged from respective outlets of the compressor stages may be relatively warmer than the process fluid at respective inlets of the compressor stages. The increase in the temperature of the process fluid discharged from the compressor stages may increase the relative amount of work or energy per unit of pressure to compress the process fluid in subsequent compressor stages.

In view of the foregoing, conventional multistage compressors may often include intercoolers (e.g., external heat exchangers) configured to extract heat or thermal energy from the process fluid flowing therethrough to thereby maintain the process fluid at a substantially constant temperature during compression. Utilizing the intercoolers, however, may increase the relative size and complexity of the multistage compressors, as additional components (e.g., piping) may often be necessary to couple the intercoolers with the compressor stages. Further, the increased complexity of the multistage compressors may correspondingly increase the overall cost associated with maintaining, servicing, and/or repairing the multistage compressors.

What is needed, then, is an improved system for cooling a process fluid in a compressor.

Embodiments of the disclosure may provide an internally-cooled diaphragm for a compressor. The internally-cooled diaphragm may include an annular body configured to cool a process fluid flowing through a fluid pathway of the compressor. The annular body may define a return channel of the fluid pathway, and a cooling pathway in thermal communication with the fluid pathway. The return channel may be configured to at least partially diffuse and de-swirl the process fluid flowing therethrough, and the cooling pathway may be configured to receive a coolant to absorb heat from the process fluid flowing through the return channel.

Embodiments of the disclosure may also provide an internally-cooled compressor including a casing at least partially defining an inlet and an outlet of a compressor stage, and a diaphragm disposed in the casing. The diaphragm may define at least a portion of a fluid pathway extending between the inlet and the outlet of the compressor stage, and may further define a cooling pathway in thermal communication with the fluid pathway. The diaphragm may include a plurality of process fluid plates, and a plurality of cooling fluid plates. Each process fluid plate of the plurality of process fluid plates may have a plurality of vanes extending axially therefrom. Each cooling fluid plate of the plurality of cooling fluid plates may define a serpentine cooling channel forming at least a portion of the cooling pathway. The plurality of process fluid plates and the plurality of cooling fluid plates are coupled with one another such that the plurality of process fluid plates and the plurality of cooling fluid plates at least partially define a return channel of the fluid pathway.

Embodiments of the disclosure may also provide another internally-cooled compressor. The internally-cooled compressor may include a casing at least partially defining a fluid pathway extending between an inlet and an outlet of a compressor stage. The fluid pathway may include an impeller cavity configured to receive an impeller, a diffuser fluidly coupled with and extending radially outward from the impeller cavity, a return bend fluidly coupled with the diffuser, and a return channel fluidly coupled with and extending radially inward from the return bend. The internally-cooled compressor may also include an internally-cooled diaphragm disposed in the return channel and defining a cooling pathway in thermal communication with the return channel. The internally-cooled diaphragm may include a plurality of process fluid plates and a plurality of cooling fluid plates. Each process fluid plate of the plurality of process fluid plates may have a plurality of vanes extending axially therefrom. Each cooling fluid plate of the plurality of cooling fluid plates may define a serpentine cooling channel forming at least a portion of the cooling pathway. The plurality of process fluid plates and the plurality of cooling fluid plates are coupled with one another such that the plurality of process fluid plates and the plurality of cooling fluid plates at least partially define a plurality of return passages. Each return passage of the plurality of return passages may include a diffusion region and a de-swirling region.

The present disclosure is best understood from the following detailed description when read with the accompanying Figures. It is emphasized that, in accordance with the standard practice in the industry, various features are not drawn to scale. In fact, the dimensions of the various features may be arbitrarily increased or reduced for clarity of discussion.

Figure 1A:
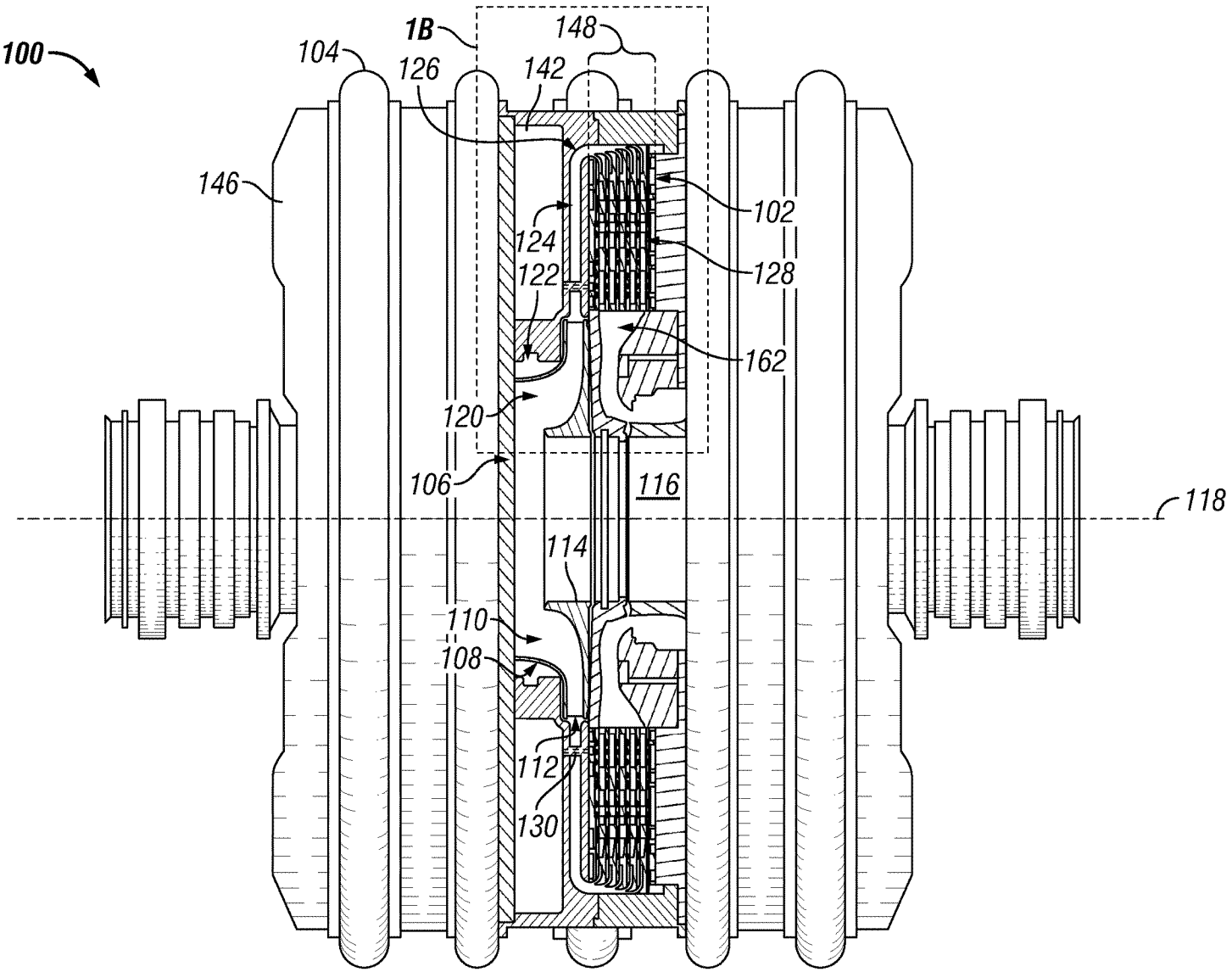
FIG. 1A illustrates a cutaway, cross-sectional view of a compressor including an exemplary internally-cooled diaphragm, according to one or more embodiments disclosed.

It is to be understood that the following disclosure describes several exemplary embodiments for implementing different features, structures, or functions of the invention. Exemplary embodiments of components, arrangements, and configurations are described below to simplify the present disclosure; however, these exemplary embodiments are provided merely as examples and are not intended to limit the scope of the invention. Additionally, the present disclosure may repeat reference numerals and/or letters in the various exemplary embodiments and across the Figures provided herein. This repetition is for the purpose of simplicity and clarity and does not in itself dictate a relationship between the various exemplary embodiments and/or configurations discussed in the various Figures. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact. Finally, the exemplary embodiments presented below may be combined in any combination of ways, i.e., any element from one exemplary embodiment may be used in any other exemplary embodiment, without departing from the scope of the disclosure.

Additionally, certain terms are used throughout the following description and claims to refer to particular components. As one skilled in the art will appreciate, various entities may refer to the same component by different names, and as such, the naming convention for the elements described herein is not intended to limit the scope of the invention, unless otherwise specifically defined herein. Further, the naming convention used herein is not intended to distinguish between components that differ in name but not function. Further, in the following discussion and in the claims, the terms "including" and "comprising" are used in an open-ended fashion, and thus should be interpreted to mean "including, but not limited to." All numerical values in this disclosure may be exact or approximate values unless otherwise specifically stated. Accordingly, various embodiments of the disclosure may deviate from the numbers, values, and ranges disclosed herein without departing from the intended scope. Furthermore, as it is used in the claims or specification, the term "or" is intended to encompass both exclusive and inclusive cases, i.e., "A or B" is intended to be synonymous with "at least one of A and B," unless otherwise expressly specified herein.

Figure 1B:
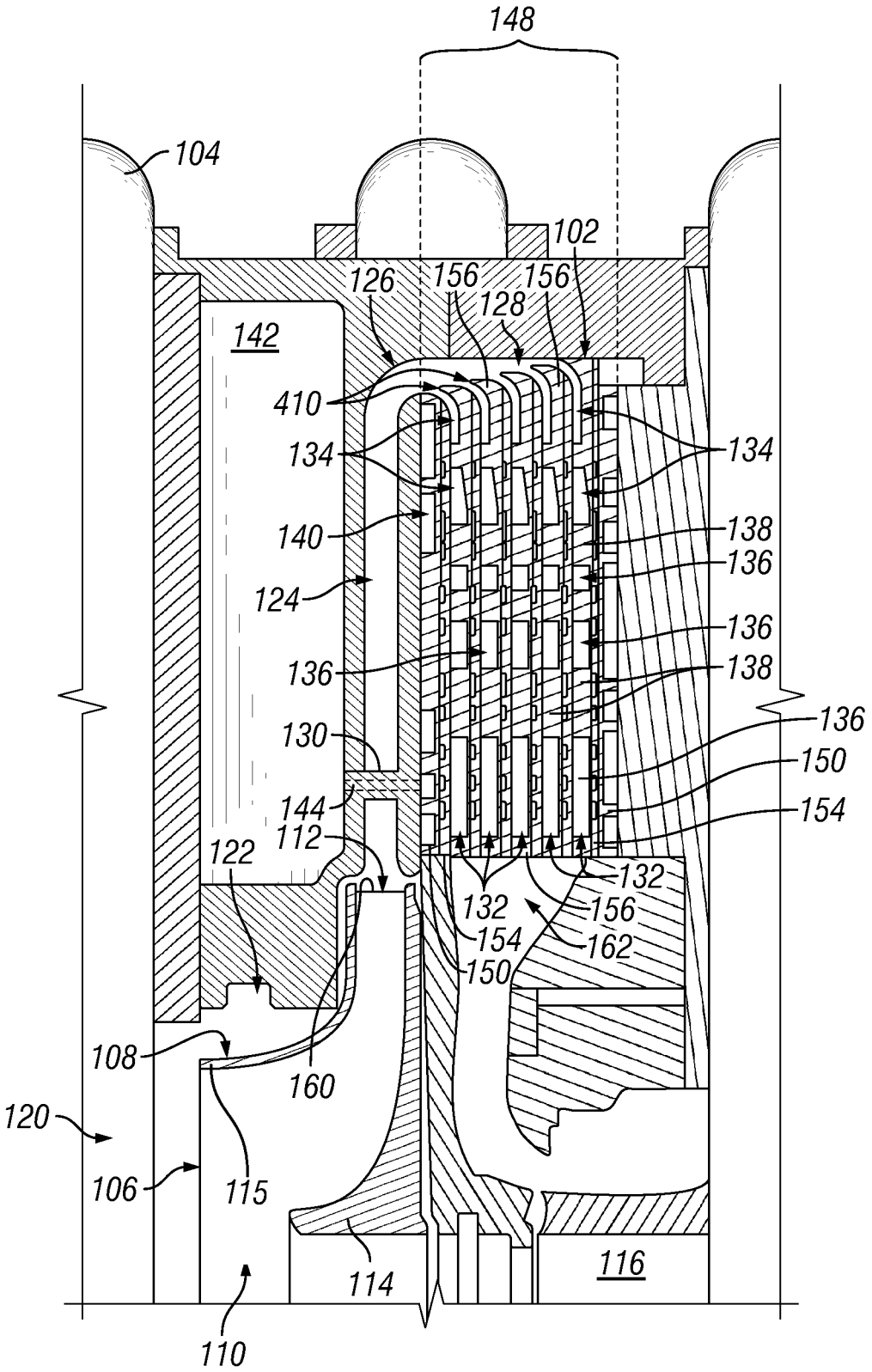
FIG. 1B illustrates an enlarged view of the compressor and the internally-cooled diaphragm thereof, indicated by the box labeled "1B" of FIG. 1A, according to one or more embodiments disclosed.

FIG. 1A illustrates a cutaway, cross-sectional view of a compressor 100 including an internally-cooled diaphragm 102, according to one or more embodiments. FIG. 1B illustrates an enlarged view of the compressor 100 indicated by the box labeled "1B" of FIG. 1A, according to one or more embodiments. As illustrated in FIGS. 1A and 1B, the compressor 100 may be a centrifugal compressor. Illustrative centrifugal compressors may include, but are not limited to, straight-thru centrifugal compressors, single-stage overhung centrifugal compressors, multistage overhung centrifugal compressors, back-to-back centrifugal compressors, or the like. The compressor 100 may include a casing 104 and one or more compressor stages (one is shown 106) configured to compress or pressurize a process fluid introduced thereto. For simplicity, FIGS. 1A and 1B illustrate a single compressor stage 106 of the compressor 100; however, it should be appreciated that the compressor 100 may include multiple compressor stages without departing from the scope of the disclosure. For example, the compressor 100 may include a first compressor stage, a final compressor stage, and one or more intermediate compressor stages disposed between the first and final compressor stages. As illustrated in FIGS. 1A and 1B, the compressor stage 106 may include an impeller 108 having an inlet, such as an impeller inlet 110, and an outlet, such as an impeller outlet 112. The impeller 108 may include a center portion or hub 114 and a plurality of blades 115 (see FIG. 1B) extending from the hub 114. The hub 114 of the impeller 108 may be coupled with a rotary shaft 116 configured to rotate the impeller 108 about an axis 118 (e.g., longitudinal axis) of the compressor 100.

As illustrated in FIG. 1A, the internally-cooled diaphragm 102 may be disposed and/or hermetically sealed in the casing 104. The casing 104 and/or the internally-cooled diaphragm 102 may at least partially define a fluid pathway 120 extending through the compressor 100 through which the process fluid may flow. For example, the internally-cooled diaphragm 102 may define at least a portion of the fluid pathway 120 extending through the compressor stage 106 of the compressor 100. The fluid pathway 120 may include an impeller cavity 122, a diffuser 124 fluidly coupled with and extending radially outward from the impeller cavity 122, a return bend 126 fluidly coupled with the diffuser 124, and a return channel 128 fluidly coupled with and extending radially inward from the return bend 126.

The impeller cavity 122 may be configured to receive the impeller 108. The diffuser 124 may be fluidly coupled with and extend radially outward from the impeller cavity 122. As further described herein, the diffuser 124 may be configured to receive the process fluid from the impeller 108 and convert kinetic energy (e.g., flow or velocity) of the process fluid from the impeller 108 to potential energy (e.g., increased static pressure). A plurality of diffuser vanes (one is shown 130) may be disposed in the diffuser 124 and configured to direct the flow of the process fluid through the diffuser 124 and/or decrease the velocity of the process fluid flowing through the diffuser 124. The return bend 126 may be configured to receive the process fluid from the diffuser 124 and divert or turn the flow of the process fluid radially inward toward the return channel 128.

As illustrated in FIG. 1B, the return channel 128 may include a plurality of return passages (five are shown 132) extending radially inward from the return bend 126 toward the rotary shaft 116. Each of the return passages 132 may include a diffusion region 134 disposed proximal an outer circumference of the internally-cooled diaphragm 102, and a de-swirling region 136 disposed radially inward from the diffusion region 134. At least one return channel vane 138 may be disposed in each of the de-swirling regions 136. As further described herein, the internally-cooled diaphragm 102 may be configured to separate or divide the flow of the process fluid from the return bend 126 and direct the separated flow into each of the return passages 132 of the return channel 128. The internally-cooled diaphragm 102 may further be configured to at least partially diffuse the flow of the process fluid through the respective diffusion regions 134 of the return passages 132, and de-swirl the flow of the process fluid in the respective de-swirling regions 136 of the return passages 132.

The casing 104 and/or the internally-cooled diaphragm 102 may also at least partially define a cooling pathway 140 through which a coolant or cooling fluid may flow. The cooling pathway 140 may be disposed near or proximal at least a portion of the fluid pathway 120. For example, the cooling pathway 140 may be disposed proximal at least a portion of the diffuser 124 and/or at least a portion of the return channel 128 of the fluid pathway 120. As further described herein, the cooling pathway 140 may be in thermal communication with the fluid pathway 120, and the cooling fluid flowing through the cooling pathway 140 may be configured to absorb (e.g., indirectly) heat from a process fluid flowing through the fluid pathway 120.

In an exemplary embodiment, the casing 104 and/or the internally-cooled diaphragm 102 may at least partially define a cooling fluid source and/or a cooling fluid drain fluidly coupled with the cooling pathway 140. For example, as illustrated in FIG. 1B, the casing 104 may define a plenum 142 configured to deliver the cooling fluid to or receive the cooling fluid from the cooling pathway 140. As further illustrated in FIG. 1B, the diffuser vanes 130 may at least partially define one or more conduits (one is shown 144) extending therethrough and configured to provide fluid communication between the plenum 142 and the cooling pathway 140. In another embodiment, the compressor 100 may include an external cooling fluid source (not shown) and/or an external cooling fluid drain (not shown). The external cooling fluid source and the external cooling fluid drain may be configured to deliver the cooling fluid to the cooling pathway 140 and receive the cooling fluid from the cooling pathway 140, respectively. In at least one embodiment, the external cooling fluid source and/or the external cooling fluid drain may be fluidly coupled with the cooling pathway 140 via a head 146 (see FIG. 1A) of the compressor 100. For example, the head 146 of the compressor 100 may at least partially define a flowpath (not shown) extending axially therethrough and configured to provide fluid communication between the cooling pathway 140 and the external cooling fluid source and/or the external cooling fluid drain. In another embodiment, the external cooling fluid source and/or the external cooling fluid drain may be fluidly coupled with the cooling pathway 140 via the casing 104. For example, the casing 104 may define a flowpath (not shown) extending radially therethrough and configured to provide fluid communication between the cooling pathway 140 and the external cooling fluid source and/or the external cooling fluid drain.

The internally-cooled diaphragm 102 may generally be an annular body. In at least one embodiment, the internally-cooled diaphragm 102 may be formed or fabricated as a single, unitary component or piece. In another embodiment, the internally-cooled diaphragm 102 may be formed from separate components or pieces coupled with one another. For example, as illustrated in FIG. 1B and further illustrated in detail in FIGS. 1C and 1D, the internally-cooled diaphragm 102 may be formed from a stack of annular plates or disks 148. The stack of plates 148 may define at least a portion of the fluid pathway 120 and the cooling pathway 140. For example, the stack of plates 148 may at least partially define the return passages 132 of the fluid pathway 120. In another example, the stack of plates 148 may define respective portions of the cooling pathway 140 in thermal communication with the return channel 128.

Figure 1C:
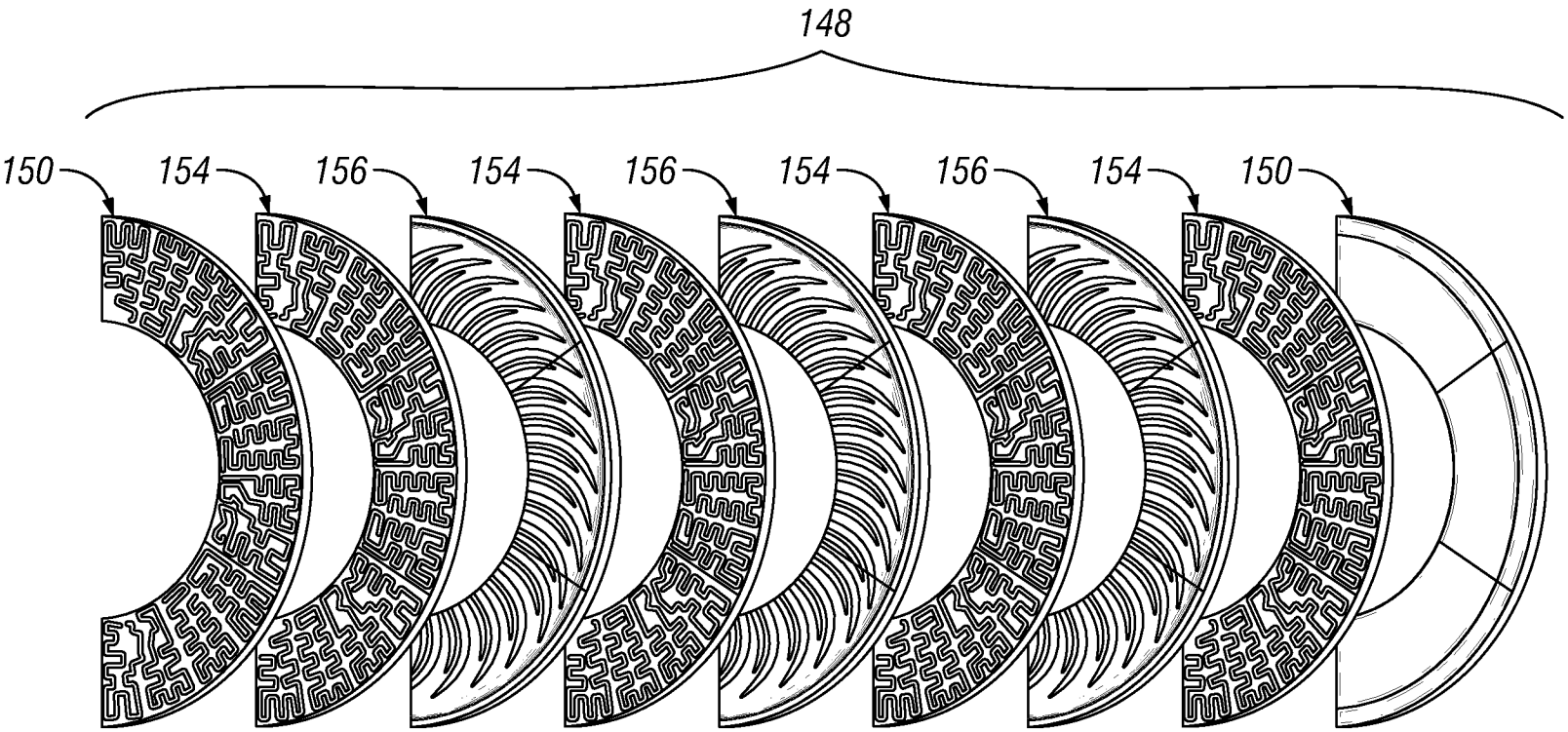
FIG. 1C illustrates a partial, exploded view of a front side of the internally-cooled diaphragm of FIGS. 1A and 1B, according to one or more embodiments disclosed.
Figure 1D:
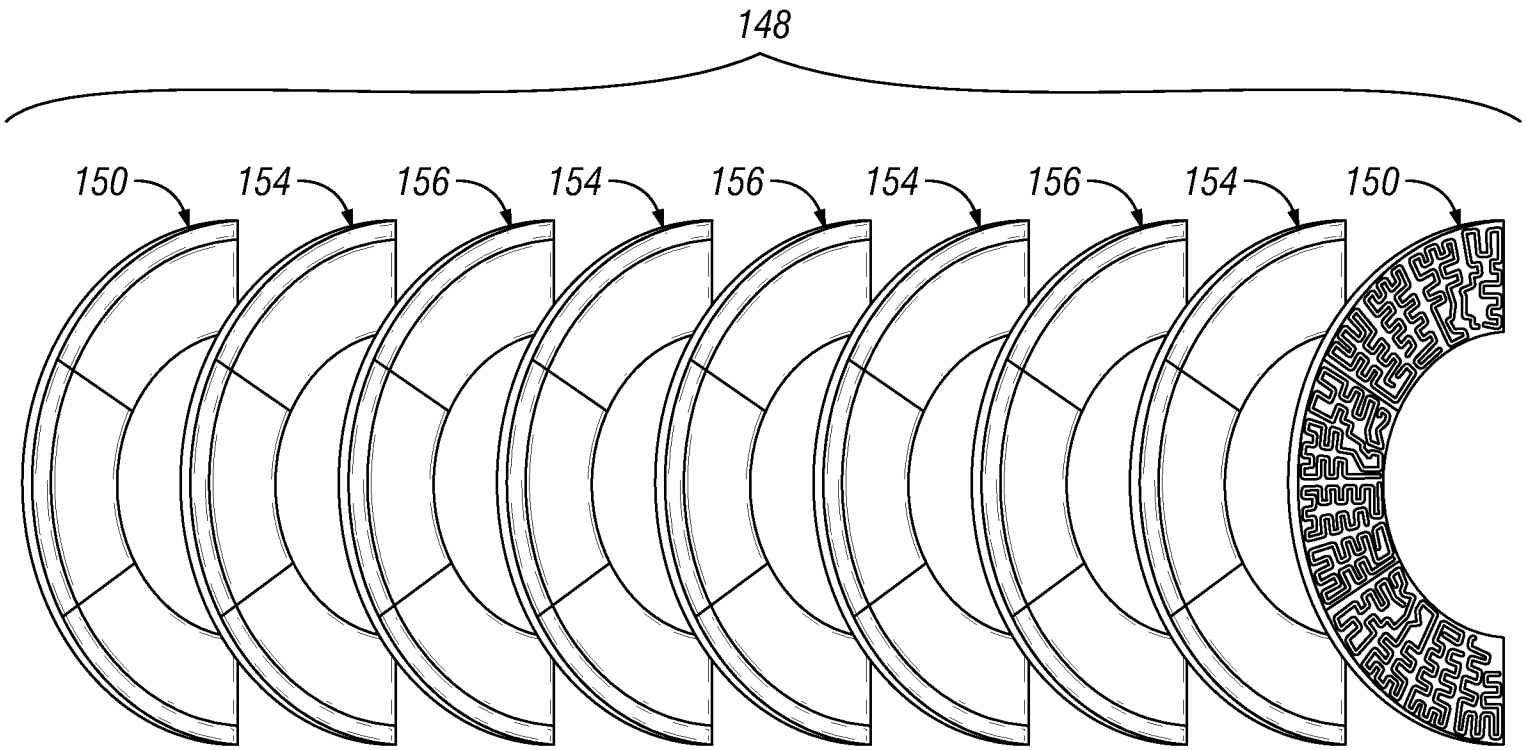
FIG. 1D illustrates a partial, exploded view of a rear side of the internally-cooled diaphragm of FIGS. 1A and 1B, according to one or more embodiments disclosed.

As illustrated in FIGS. 1C and 1D, the stack of plates 148 may include one or more end plates (two are shown 150), one or more cooling fluid plates (four are shown 154), and/or one or more process fluid plates (four are shown 156). As further described herein, the process fluid plates 156, the cooling fluid plates 154, and/or the end plates 150 may at least partially define the fluid pathway 120 and/or the cooling pathway 140. The process fluid plates 156, the cooling fluid plates 154, and/or the end plates 150 may be annular plates (e.g., annular, metal-based plates), and may be fabricated using one or more milling or etching processes or techniques. For example, the process fluid plates 156, the cooling fluid plates 154, and/or the end plates 150 may be fabricated via a mechanical milling process or a water jet technique. The process fluid plates 156, the cooling fluid plates 154, and/or the end plates 150 may be bonded, welded, brazed, or otherwise coupled with one another to form the stack of plates 148 of the internally-cooled diaphragm 102. The process fluid plates 156, the cooling fluid plates 154, and/or the end plates 150 may be coupled with one another in any combination or sequence to form the stack of plates 148. The stack of plates 148 formed may generally be a cylindrical or annular component configured to be at least partially disposed in the compressor stage 106 of the compressor 100. For example, the stack of plates 148 may be at least partially disposed in and may further form a portion of the fluid pathway 120 (e.g., the return channel 128) of the compressor stage 106.

Figure 2A:
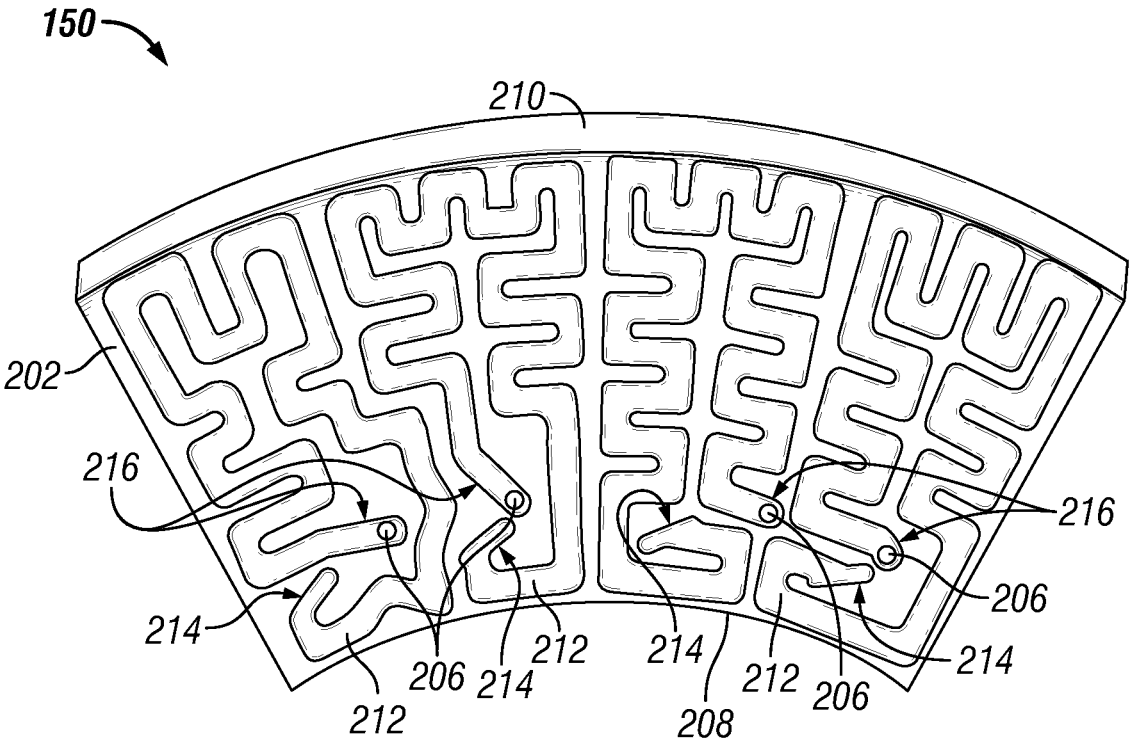
FIG. 2A illustrates a partial plan view of a first axial surface of the end plate illustrated in FIGS. 1C and 1D, according to one or more embodiments disclosed.
Figure 2B:
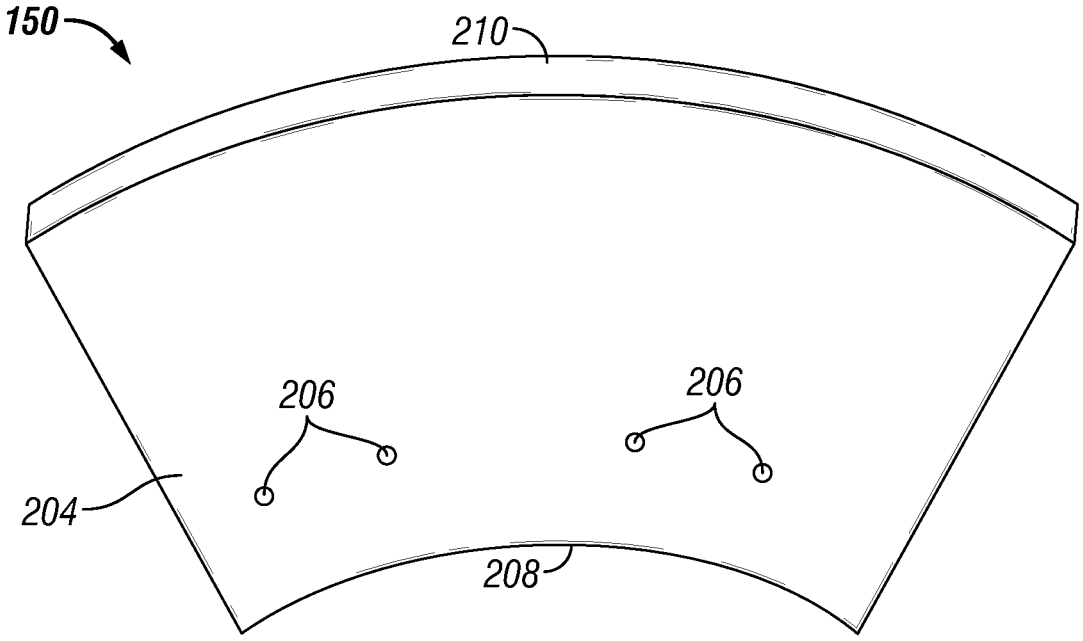
FIG. 2B illustrates a partial plan view of a second axial surface of the end plate of FIG. 2A, according to one or more embodiments disclosed.

FIG. 2A illustrates a partial plan view of a first axial surface 202 of the end plate 150 illustrated in FIGS. 1C and 1D, according to one or more embodiments. FIG. 2B illustrates a partial plan view of a second axial surface 204 of the end plate 150 of FIG. 2A, according to one or more embodiments. The end plate 150 may generally be disk-shaped. It may be appreciated, however, that the end plate 150 may be any shape. For example, the end plate 150 may be elliptical, square, or rectangular. The end plate 150 may define one or more cooling ports (four are shown 206) extending axially therethrough. For example, as illustrated in FIGS. 2A and 2B, the cooling ports 206 may extend through the end plate 150 from the first axial surface 202 to the second axial surface 204. The cooling ports 206 may be disposed near or proximal an inner circumferential surface 208 or an outer circumferential surface 210 of the end plate 150. For example, as illustrated in FIG. 2A, the cooling ports 206 may be disposed proximal the inner circumferential surface 208 of the end plate 150.

The end plate 150 may define one or more cooling channels (four are shown 212) along or in the first axial surface 202 thereof. As illustrated in FIG. 2A, respective first end portions 214 of the cooling channels 212 may be disposed or originate proximal the inner circumferential surface 208 of the end plate 150. As further illustrated in FIG. 2A, respective second end portions 216 of the cooling channel 212 may be fluidly coupled with the cooling ports 206. The cooling ports 206 and the cooling channels 212 fluidly coupled therewith may form at least a portion of the cooling pathway 140 (see FIG. 1B) extending through the internally-cooled diaphragm 102. Each of the cooling channels 212 may generally extend from the respective first end portion 214, disposed proximal the inner circumferential surface 208, toward the outer circumferential surface 210, and may further extend from the outer circumferential surface 210 to the respective second end portion 216. Each of the cooling channels 212 may generally extend between the inner circumferential surface 208 and the outer circumferential surface 210 in a serpentine pattern or path.

Figure 3A:
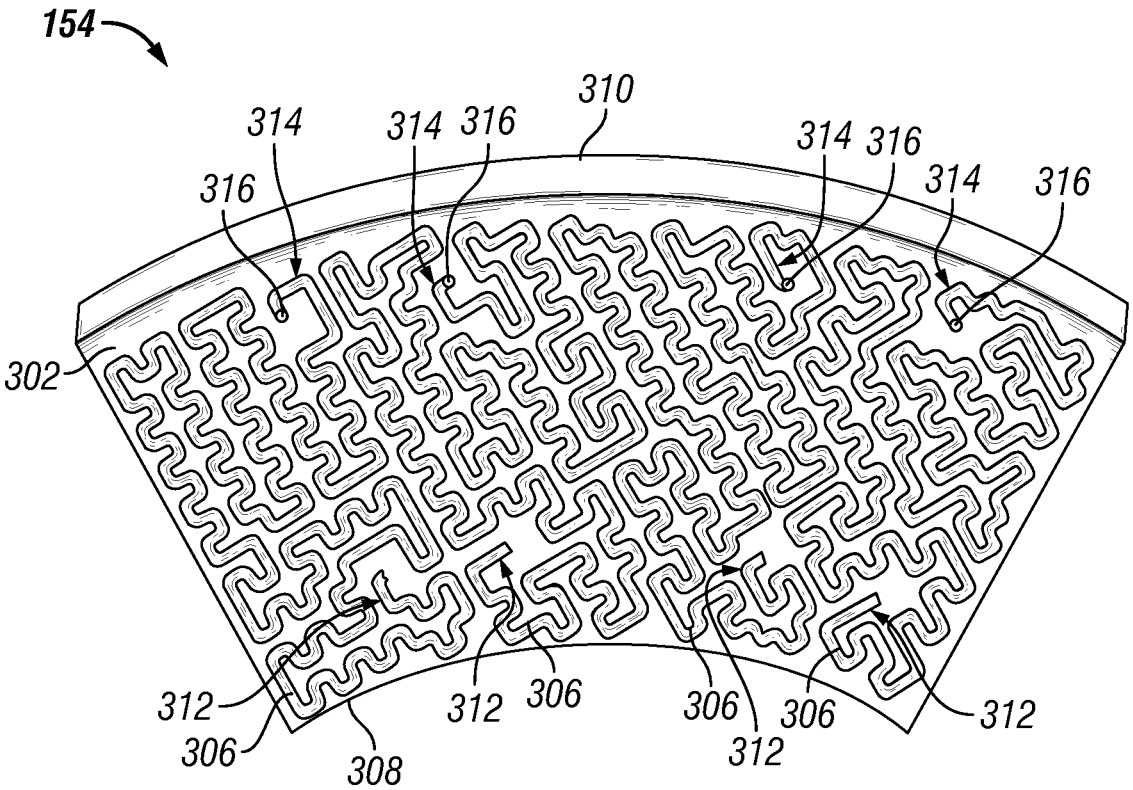
FIG. 3A illustrates a partial plan view of a first axial surface of the cooling fluid plate illustrated in FIGS. 1C and 1D, according to one or more embodiments disclosed.
Figure 3B:
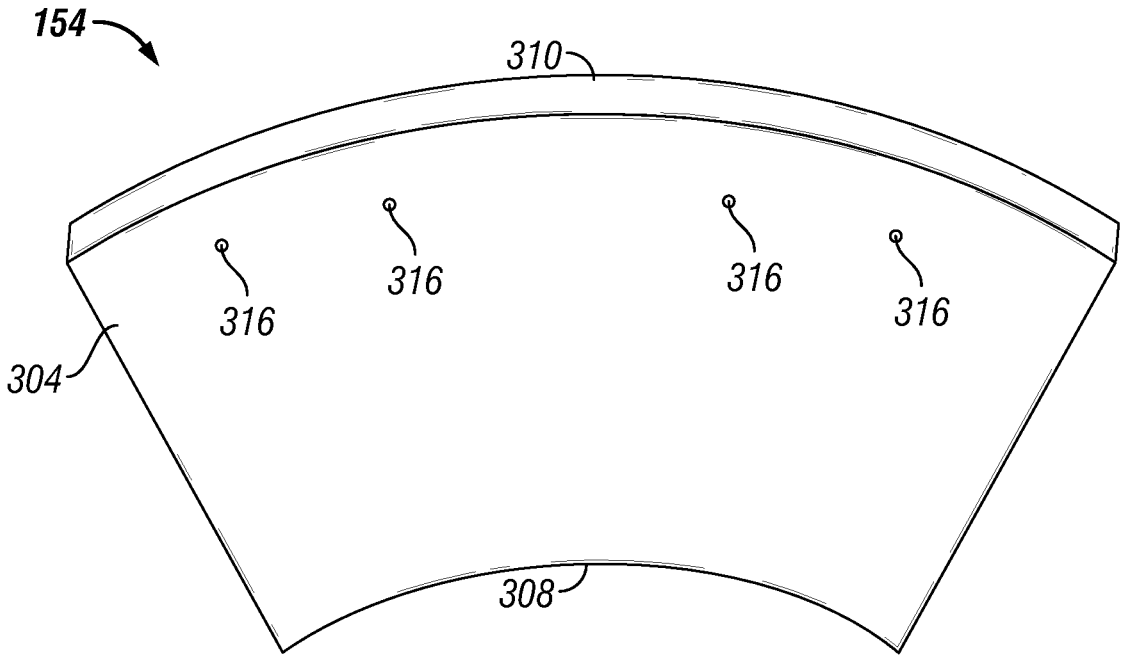
FIG. 3B illustrates a partial plan view of a second axial surface of the cooling fluid plate of FIG. 3A, according to one or more embodiments disclosed.

FIG. 3A illustrates a partial plan view of a first axial surface 302 of the cooling fluid plate 154 illustrated in FIGS. 1C and 1D, according to one or more embodiments. FIG. 3B illustrates a partial plan view of a second axial surface 304 of the cooling fluid plate 154 of FIG. 3A, according to one or more embodiments. The cooling fluid plate 154 may have a shape similar to the end plate 150 described above with reference to FIGS. 2A and 2B. For example, as illustrated in FIGS. 3A and 3B, the cooling fluid plate 154 may generally be disk-shaped. It should be appreciated, however, that the cooling fluid plate 154 may be any suitable shape (e.g., elliptical, square, or rectangular).

The cooling fluid plate 154, similar to the end plate 150, may define one or more cooling channels (four are shown 306) along or in the first axial surface 302 thereof. The cooling channels 306 may generally extend between an inner circumferential surface 308 and an outer circumferential surface 310 of the cooling fluid plate 154. For example, as illustrated in FIG. 3A, respective first end portions 312 of the cooling channels 306 may be disposed proximal the inner circumferential surface 308, and respective second end portions 314 of the cooling channels 306 may be disposed proximal the outer circumferential surface 310. As further illustrated in FIG. 3A, the cooling channels 306 may generally extend between the respective first and second end portions 312, 314 in a serpentine pattern.

As illustrated in FIGS. 3A and 3B, the cooling fluid plate 154 may define one or more cooling ports (four are shown 316) extending axially therethrough from the first axial surface 302 to the second axial surface 304. The cooling ports 316 may be disposed near or proximal the outer circumferential surface 310 of the end plate 154. The cooling ports 316 may also be in fluid communication with the cooling channels 306. For example, the cooling ports 316 may be in fluid communication with the respective second end portions 314 of the cooling channels 306. The cooling ports 316 and/or the respective cooling channels 306 fluidly coupled therewith may form at least a portion of the cooling pathway 140 (see FIG. 1B) extending through the internally-cooled diaphragm 102. In an exemplary embodiment, the respective first end portions 312 of the cooling channels 306 may be fluidly coupled with the respective cooling channels 212 (see FIGS. 2A and 2B) of the end plate 150 and configured to receive the cooling fluid therefrom. For example, the first end portions 312 of the cooling channels 306 may be fluidly coupled with the cooling channels 212 (see FIGS. 2A and 2B) of the end plate 150 via the cooling ports 206 and configured to receive the cooling fluid therefrom. The respective second end portions 314 of the cooling channels 306 may be fluidly coupled with a return line (not shown) and configured to direct or return the cooling fluid to a cooling fluid source (e.g., the plenum 142 or an external cooling fluid source) via the return line.

Figure 4A:
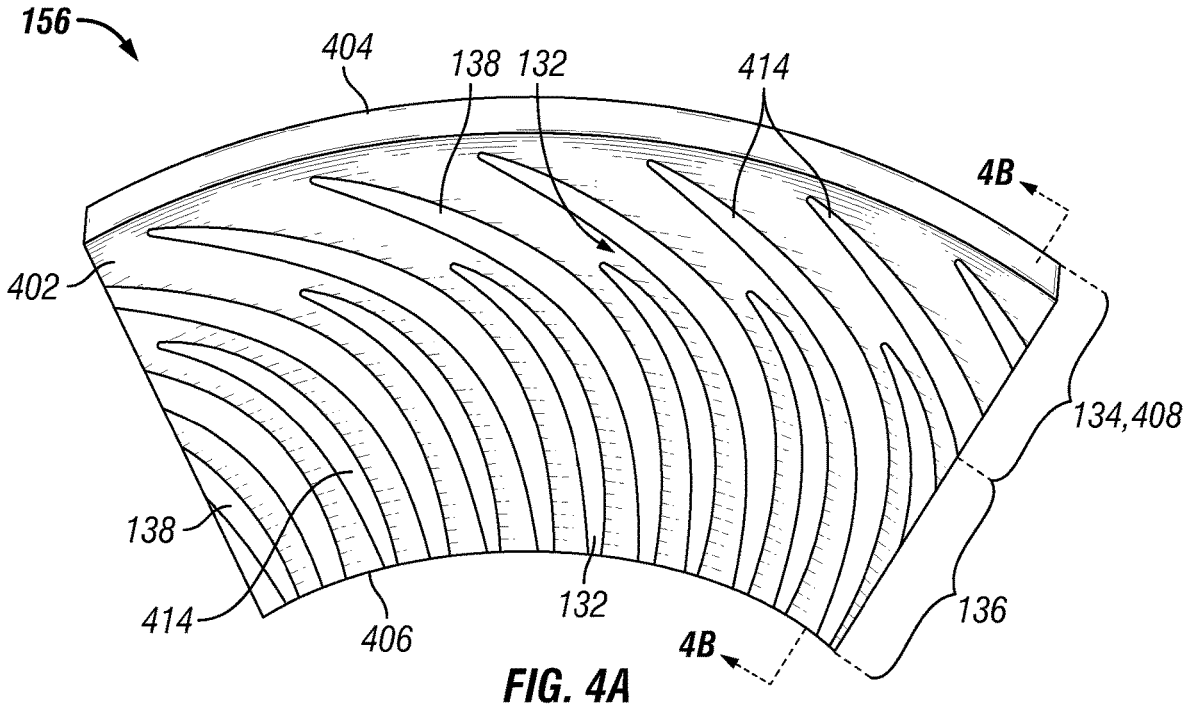
FIG. 4A illustrates a partial plan view of a first axial surface of the process fluid plate illustrated in FIGS. 1C and 1D, according to one or more embodiments disclosed.
Figure 4B:
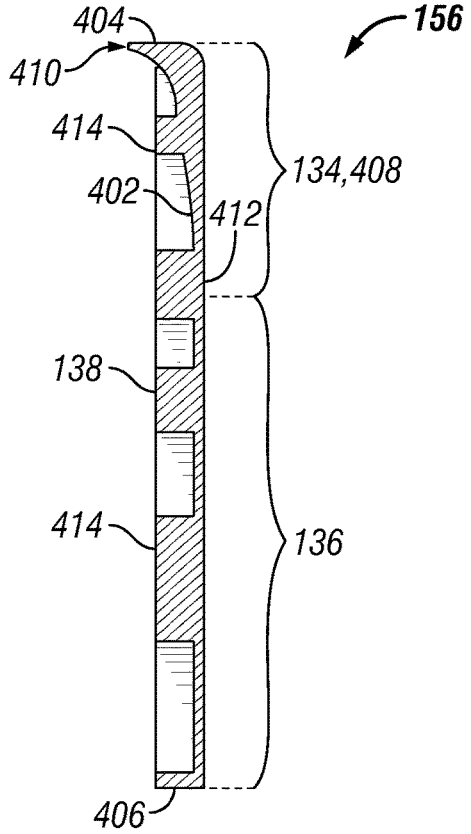
FIG. 4B illustrates a cross-sectional view of the process fluid plate taken along line 4B-4B in FIG. 4A, according to one or more embodiments disclosed.

FIG. 4A illustrates a partial plan view of a first axial surface 402 of the process fluid plate 156 illustrated in FIGS. 1C and 1D, according to one or more embodiments. FIG. 4B illustrates a cross-sectional view of the process fluid plate 156 taken along line 4B-4B in FIG. 4A, according to one or more embodiments. As illustrated in FIGS. 4A and 4B, the return channel vanes 138 may be coupled with the first axial surface 402 of the process fluid plate 156. The return channel vanes 138 may generally extend radially between an outer circumferential surface 404 of the process fluid plate 156 and an inner circumferential surface 406 of the process fluid plate 156. The first axial surface 402 and/or the return channel vanes 138 extending therefrom may at least partially define the return passages 132 of the return channel 128 (see FIG. 1B). For example, adjacent return channel vanes 138 may at least partially define respective return passages 132 therebetween. In another example, the first axial surface 402 and the return channel vanes 138 extending therefrom may at least partially define the respective diffusion regions 134 (see FIG. 4B) and/or the respective de-swirling regions 136 (see FIG. 4B) of the return passages 132. The return channel vanes 138 may have any suitable shape and/or size configured to at least partially diffuse the process fluid flowing through the respective diffusion regions 134 of the return passages 132. The return channel vanes 138 may also be shaped and/or sized to at least partially de-swirl the process fluid flowing through the respective de-swirling regions 136 of the return passages 132.

An outer annular portion 408 of the process fluid plate 156 may be shaped to form the respective diffusion regions 134 of the return passages 132. For example, as illustrated in FIG. 4B, the outer annular portion 408 may taper from the outer circumferential surface 404 of the process fluid plate 156 toward the inner circumferential surface 406 of the process fluid plate 156. As further illustrated in FIG. 4B, the outer annular portion 408 of the process fluid plate 156 may form a lip or turning vane 410. The turning vane 410 may extend in an axial direction from a second axial surface 412 toward the first axial surface 402. The turning vane 410 may be configured to form at least a portion of the return bend 126 (see FIG. 1B). The turning vane 410 may also be configured to at least partially separate the flow of the process fluid into each of the return passages 132 of the return channel 128.

As illustrated in FIGS. 4A and 4B, respective top surfaces 414 of the return channel vanes 138 may be planar or substantially planar with one another. Accordingly, the respective top surfaces 414 of the return channel vanes 138 may be mounted flush to an adjacent component (e.g., an adjacent process fluid plate 156, an adjacent cooling fluid plate 154, or an adjacent end plate 150) of the internally-cooled diaphragm 102, such that the adjacent component may at least partially provide a cover for the return passages 132.

As previously discussed, the process fluid plates 156 (see FIGS. 1B, 4A, and 4B) the cooling fluid plates 154 (see FIGS. 1B, 3A, and 3B), and/or the end plates 150 (see FIGS. 1B, 2A, and 2B) may be coupled with one another to form the stack of plates 148 of the internally-cooled diaphragm 102 (see FIGS. 1A-1D). Any number of the process fluid plates 156, the cooling fluid plates 154, and/or the end plates 150 may be used to form the stack of plates 148. The number of the process fluid plates 156, the cooling fluid plates 154, and/or the end plates 150 included in the stack of plates 148 may be at least partially determined by one or more parameters of the compressor 100. For example, the number of the process fluid plates 156, the cooling fluid plates 154, and/or the end plates 150 may be at least partially determined by a size of the compressor 100, an axial length of the internally-cooled diaphragm 102, a flowrate of the process gas and/or the cooling fluid, or the like, or any combination thereof.

In at least one embodiment, the process fluid plates 156, the cooling fluid plates 154, and/or the end plates 150 may be interleaved with one another to form at least a portion of the stack of plates 148. For example, the process fluid plates 156 and the cooling fluid plates 154 may be disposed or stacked adjacent one another in an alternating sequence where one of the process fluid plates 156 may be followed by one of the cooling fluid plates 154 to form at least a portion of the stack of plates 148. Similarly, the end plates 150 and the cooling fluid plates 154 may be disposed or stacked adjacent one another in an alternating sequence where one of the end plates 150 may be followed by one of the cooling fluid plates 154 to form at least a portion of the stack of plates 148. In another example, the process fluid plates 156 and the end plates 150 may be disposed adjacent one another in an alternating sequence where one of the process fluid plates 156 may be followed by one of the end plates 150 to form at least a portion of the stack of plates 148. In another example, the stack of plates 148 may be formed such that one, two, or more of the process fluid plates 156 may be stacked with one another and followed by one, two, or more of the cooling fluid plates 154 or the end plates 150. In another example, the stack of plates 148 may be formed such that one, two, or more of the cooling fluid plates 154 may be stacked with one another and followed by one, two, or more of the process fluid plates 156 or the end plates 150. In yet another example, the stack of plates 148 may be formed such that one, two, or more of the end plates 150 may be stacked with one another and followed by one, two, or more of the process fluid plates 156 or the cooling fluid plates 154. Accordingly, it should be appreciated that the process fluid plates 156, the cooling fluid plates 154, and/or the end plates 150 may be stacked in any sequence, and the sequence of the process fluid plates 156, the cooling fluid plates 154, and/or the end plates 150 may be varied through the stack of plates 148. Further, while the process fluid plates 156, the cooling fluid plates 154, and/or the end plates 150 may be illustrated as separate or discrete plates, it may be appreciated that the respective features of the process fluid plates 156, the cooling fluid plates 154, and/or the end plates 150 may be combined into a single plate. For example, the respective features of the process fluid plate 156 and the cooling fluid plates 154 discussed herein may represent opposing axial faces of a single plate.

In an exemplary embodiment, illustrated in FIGS. 1B-1D, opposing axial end portions of the internally-cooled diaphragm 102 may be formed by respective end plates 150. As further illustrated in FIGS. 1B-1D, the cooling fluid plates 154 and the process fluid plates 156 may be disposed between the respective end plates 150 in an alternating sequence to form the remaining portions of the internally-cooled diaphragm 102. The process fluid plates 156, the cooling fluid plates 154, and/or the end plates 150 may be stacked with one another in any orientation. For example, the process fluid plates 156, the cooling fluid plates 154, and/or the end plates 150 may be oriented such that the respective first axial surfaces 202, 302, 402 thereof face an upstream side of the compressor 100. In another example, the process fluid plates 156, the cooling fluid plates 154, and/or the end plates 150 may be oriented such that the respective first axial surfaces 202, 302, 402 thereof face a downstream side of the compressor 100. In an exemplary embodiment, illustrated in FIG. 1B, the end plates 150 may be oriented such that the respective first axial surfaces 202 thereof face opposing sides (i.e., upstream and downstream sides) of the compressor 100. As further illustrated in FIG. 1B, the respective first axial surfaces 302, 402 of the cooling fluid plates 154 and the process fluid plates 156 may face the upstream side of the compressor 100.

In an exemplary operation, with continued reference to FIGS. 1A-4B, the rotary shaft 116 may rotate the impeller 108 at a speed sufficient to draw a process fluid into the casing 104 of the compressor 100. The rotation of the impeller 108 may also draw the process fluid to and through the impeller 108 and urge the process fluid to a tip 160 of the impeller 108, thereby increasing the velocity of the process fluid. The plurality of blades 115 of the impeller 108 may raise the velocity and energy of the process fluid and direct the process fluid from the impeller 108 to the diffuser 124 fluidly coupled therewith. The diffuser 124 may receive the process fluid from the impeller 108 and convert the kinetic energy (e.g., flow or velocity) of the process fluid to potential energy (e.g., increased static pressure) by decreasing the velocity of the process fluid flowing therethrough. The plurality of diffuser vanes 130 may direct or deflect the flow of the process fluid through the diffuser 124 to decrease the velocity of the process fluid and increase the static pressure. The conversion of the velocity of the process fluid to increased static pressure may thereby compress the process fluid, and the compression of the process fluid may generate heat (e.g., heat of compression) to increase a temperature of the compressed process fluid. The return bend 126 may receive the compressed process fluid from the diffuser 124 and direct or turn the flow of the process fluid radially inward toward the internally-cooled diaphragm 102 defining the return channel 128.

The internally-cooled diaphragm 102 may at least partially separate or divide the flow of the process fluid from the return bend 126 into the return passages 132 of the return channel 128. For example, the respective turning vanes 410 formed about the respective outer annular portions 408 (see FIG. 4B) of the process fluid plates 156 may at least partially separate the flow of the process fluid from the return bend 126 into separate flows, and each separate flow of the process fluid may be directed to a respective return passage 132 of the return channel 128. The internally-cooled diaphragm 102 may at least partially diffuse the process fluid flowing through each of the return passages 132 of the return channel 128. For example, the process fluid may be at least partially diffused through respective diffusion regions 134 of the return passages 132. The diffusion of the process fluid through the respective diffusion regions 134 of the return passages 132 may further reduce the velocity and increase the pressure or compression of the process fluid. The diffusion of the process fluid through the respective diffusion regions 134 of the return passages 132 may also increase the stability and decrease separation of the process fluid. For example, boundary layers of the process fluid may be less susceptible to separation when utilizing the diffusion regions 134.

The internally-cooled diaphragm 102 may also at least partially de-swirl the flow of the process fluid flowing through the return passages 132 of the return channel 128. For example, the respective de-swirling regions 136 of the return passages 132 and/or the respective return channel vanes 138 disposed in the return passages 132 may at least partially de-swirl the process fluid flowing through the return channel 128. The diffused, de-swirled process fluid flowing through each of the return passages 132 may collect or be combined with one another in a collection region 162 (see FIG. 1B) of the return channel 128. The process fluid in the collection region 162 of the return channel 128 may be discharged from the compressor 100 or introduced to a downstream compressor stage (not shown).

As previously discussed, the compression of the process fluid through the fluid pathway 120 may generate heat to thereby increase the temperature of the process fluid. Accordingly, a cooling fluid may be directed to and through the cooling pathway 140 of the internally-cooled diaphragm 102 to at least partially absorb the heat from the process fluid flowing through the fluid pathway 120. In one example, the cooling fluid directed to the cooling pathway 140 of the internally-cooled diaphragm 102 may be contained in an external cooling fluid source (not shown) and delivered to the cooling pathway 140 via a supply line (not shown). In another example, illustrated in FIG. 1B, the cooling fluid directed to the cooling pathway 140 of the internally-cooled diaphragm 102 may be contained in the plenum 142 and delivered to the cooling pathway 140 via the conduits 144 extending through the diffuser vanes 130. The cooling fluid delivered to the cooling pathway 140 via the conduits 144 may be directed to the end plate 150 of the internally-cooled diaphragm 102. For example, the cooling fluid may be delivered from the conduits 144 to the respective first end portions 214 (see FIG. 2A) of the cooling channels 212 of the end plate 150. The cooling fluid may flow from the respective first end portions 214 to the respective second end portions 216 (see FIG. 2A) of the cooling channels 212 via the serpentine path.

The cooling fluid may flow from the end plate 150 to one or more of the cooling fluid plates 154 (see FIGS. 3A and 3B) of the internally-cooled diaphragm 102. For example, the cooling fluid from the end plate 150 may be directed to the respective cooling channels 306 (see FIG. 3A) of the cooling fluid plates 154 via the respective cooling ports 206. The cooling fluid may flow radially outward through the respective cooling channels 306 of each of the cooling fluid plates 154 to thereby absorb at least a portion of the heat contained in the process fluid flowing through the return passages 132 of the internally-cooled diaphragm 102. For example, as previously discussed, the cooling fluid plates 154 may be stacked adjacent the process fluid plates 156 (see FIGS. 1B, 4A, and 4B). By stacking the cooling fluid plates 154 adjacent the process fluid plates 156, heat from the process fluid flowing through the respective return passages 132 may be transferred to the process fluid plates 156, and subsequently transferred to the cooling fluid plates 154 thermally coupled therewith. The heat may be transferred from the cooling fluid plates 154 to the cooling fluid flowing through the respective cooling channels 306 thereof. Further, in some embodiments where the cooling fluid plates 154 may be mounted flush to the respective second axial surfaces 412 of the process fluid plates 156, at least a portion of the heat from the process fluid plates 156 may be transferred directly to the cooling fluid, as the second axial surface 412 of the process fluid plates 156 may provide the cover for the respective cooling channels 306 of the cooling fluid plates 154. Similarly, in embodiments where the process fluid plates 156 may be mounted flush to the second axial surfaces 304 of the cooling fluid plates 154, at least a portion of the heat from the process fluid flowing through the respective return passages 132 of the process fluid plates 156 may be transferred directly to the cooling fluid plates 154, as the respective second axial surfaces 304 of the cooling fluid plates 154 may provide the cover for the respective return passages 132 of the process fluid plates 156.

The cooling fluid flowing through the respective cooling channels 306 of the cooling fluid plates 154 may then be discharged from the cooling fluid plates 154 via the respective cooling fluid ports 316 thereof. The cooling fluid discharged from the cooling fluid plates 154 may then be discharged from the internally-cooled diaphragm 102. For example, the cooling fluid discharged from the respective cooling fluid ports 316 of the cooling fluid plates 154 may be discharged from the internally-cooled diaphragm 102 and directed to a cooling fluid drain (not shown) or an external cooling fluid drain (not shown) via a return line (not shown). In another example, the cooling fluid discharged from the respective cooling fluid ports 316 of the cooling fluid plates 154 may be discharged from the internally-cooled diaphragm 102 via the end plate 150. For example, the cooling fluid discharged from the cooling fluid plates 154 may be directed to and through the respective cooling channels 212 of the end plate 150, and discharged from the end plate 150 to the cooling fluid drain (not shown) or the external cooling fluid drain (not shown) via the return line (not shown).

The foregoing has outlined features of several embodiments so that those skilled in the art may better understand the present disclosure. Those skilled in the art should appreciate that they may readily use the present disclosure as a basis for designing or modifying other processes and structures for carrying out the same purposes and/or achieving the same advantages of the embodiments introduced herein. Those skilled in the art should also realize that such equivalent constructions do not depart from the spirit and scope of the present disclosure, and that they may make various changes, substitutions, and alterations herein without departing from the spirit and scope of the present disclosure.

We claim:

1. An internally-cooled diaphragm for a compressor, comprising:

an annular body configured to cool a process fluid flowing through a fluid pathway of the compressor, the annular body defining;

a return channel of the fluid pathway, the return channel configured to at least partially diffuse and de-swirl the process fluid flowing therethrough, and a cooling pathway in thermal communication with the fluid pathway, the cooling pathway configured to receive a coolant to absorb beat from the process fluid flowing through the return channel, wherein the annular body comprises a process fluid plate including a plurality of return channel vanes extending from a first axial surface thereof, the return channel vanes at least partially defining a plurality of return passages of the return channel, wherein the process fluid plate comprises a turning vane extending axially from an outer annular portion thereof, the turning vane is configured to separate the process fluid into a plurality of separated flows and direct each separated flow of the plurality of separated flows to a respective return passage of the plurality of return passages.

2. The internally-cooled diaphragm of claim 1, wherein the return channel comprises a plurality of return passages.

3. The internally-cooled diaphragm of claim 2, wherein each return passage of the plurality of return passages comprises a diffusion region disposed proximal an outer circumference of the annular body and configured to at least partially diffuse the process fluid flowing therethrough.

4. The internally-cooled diaphragm of claim 3, wherein each return passage of the plurality of return passages further comprises a de-swirling region disposed radially inward from the diffusion region and configured to at least partially de-swirl the process fluid flowing therethrough.

5. The internally-cooled diaphragm of claim 4, further comprising at least one return channel vane disposed in each return passage of the plurality of return passages, the at least one return channel vane configured to at least partially de-swirl the process fluid flowing through the return channel.

6. The internally-cooled diaphragm of claim 1, wherein the annular body further comprises a cooling fluid plate coupled with the process fluid plate, the cooling fluid plate defining a cooling channel forming at least a portion of the cooling pathway and in thermal communication with at least one return passage of the plurality of return passages.

7. An internally-cooled compressor, comprising:

a casing at least partially defining an inlet and an outlet of a compressor stage;

a diaphragm disposed in the casing, the diaphragm defining at least a portion of a fluid pathway extending between the inlet and the outlet of the compressor stage, and further defining a cooling pathway in thermal communication with the fluid pathway, the diaphragm comprising;

a plurality of process fluid plates, each process fluid plate of the plurality of process fluid plates having a plurality of vanes extending axially therefrom; and a plurality of cooling fluid plates, each cooling fluid plate of the plurality of cooling fluid plates defining a serpentine cooling channel forming at least a portion of the cooling pathway, wherein the plurality of process fluid plates and the plurality of cooling fluid plates are coupled with one another such that the plurality of process fluid plates and the plurality of cooling fluid plates at least partially define a return channel of the fluid pathway, wherein each process fluid plate of the plurality of process fluid plates comprises a turning vane extending axially from an outer annular portion thereof, the respective turning vanes of the plurality of process fluid plates are configured to separate the process fluid into a plurality of separated flows and direct each separated flow of the plurality of separated flows to a respective return passage of the plurality of return passages.

8. The internally-cooled compressor of claim 7, wherein the plurality of process fluid plates and the plurality of cooling fluid plates are coupled with one another in an alternating sequence.

9. The internally-cooled compressor of claim 7, wherein the plurality of process fluid plates and the plurality of cooling fluid plates are coupled with one another such that a first process fluid plate of the plurality of process fluid plates is disposed adjacent one or more cooling fluid plates of the plurality of cooling fluid plates.

10. The internally-cooled compressor of claim 7, wherein each return passage of the plurality of return passages comprises a diffusion region disposed proximal an outer circumference of the diaphragm and configured to at least partially diffuse a process fluid flowing therethrough.

11. The internally-cooled compressor of claim 10, wherein each return passage of the plurality of return passages further comprises a de-swirling region disposed radially inward from the diffusion region and configured to receive and de-swirl the process fluid from the diffusion region.

12. The internally-cooled compressor of claim 7, wherein the fluid pathway is configured to direct a process fluid from the inlet to the outlet of the compressor stage, and the cooling pathway is configured to receive a coolant to absorb heat from the process fluid flowing through the fluid pathway.

13. The internally-cooled compressor of claim 12, further comprising a compressor head defining an axial flowpath configured to provide fluid communication between the cooling pathway and an external coolant source.

14. The internally-cooled compressor of claim 12, wherein the casing defines a plenum configured to deliver the coolant to the cooling pathway.

15. An internally-cooled compressor, comprising:

a casing at least partially defining an inlet and an outlet of a compressor stage;

a diaphragm disposed in the casing, the diaphragm defining at least a portion of a fluid pathway extending between the inlet and the outlet of the compressor stage, and further defining a cooling pathway in thermal communication with the fluid pathway, the diaphragm comprising;

a plurality of process fluid plates, each process fluid plate of the plurality of process fluid plates having a plurality of vanes extending axially therefrom;

a plurality of cooling fluid plates, each cooling fluid plate of the plurality of cooling fluid plates defining a serpentine cooling channel forming at least a portion of the cooling pathway, wherein the plurality of process fluid plates and the plurality of cooling fluid plates are coupled with one another such that the plurality of process fluid plates and the plurality of cooling fluid plates at least partially define a return channel of the fluid pathway, wherein the fluid pathway is configured to direct a process fluid from the inlet to the outlet of the compressor stage, and the cooling pathway is configured to receive a coolant to absorb heat from the process fluid flowing through the fluid pathway, wherein the casing defines a plenum configured to deliver the coolant to the cooling pathway, and at least one diffuser vane disposed in the fluid pathway, the diffuser vane defining a conduit fluidly coupling the plenum with the cooling pathway.

* * * * *